US010316528B2

(12) United States Patent
Bartel-Lingg et al.

(10) Patent No.: US 10,316,528 B2
(45) Date of Patent: Jun. 11, 2019

(54) FLOOR COVERING COMPRISING AT LEAST ONE ELECTRICAL COMPONENT AND METHOD FOR PRODUCING A FLOOR COVERING

(71) Applicant: <BARIT> (R)—Kunstharz-Belagstechnik GmbH, Esslingen (DE)

(72) Inventors: Gabriele Bartel-Lingg, Esslingen (DE); Andre Bartel, Esslingen (DE)

(73) Assignee: <BARIT> (R)-KUNSTHARZ-BELAGSTECHNIK GMBH, Esslingen (DE)

( * ) Notice: Subject to any disclaimer, the term of this patent is extended or adjusted under 35 U.S.C. 154(b) by 0 days.

(21) Appl. No.: 15/747,659

(22) PCT Filed: Jul. 22, 2016

(86) PCT No.: PCT/EP2016/067582
§ 371 (c)(1),
(2) Date: Jan. 25, 2018

(87) PCT Pub. No.: WO2017/017033
PCT Pub. Date: Feb. 2, 2017

(65) Prior Publication Data

US 2018/0216354 A1 Aug. 2, 2018

(30) Foreign Application Priority Data

Jul. 27, 2015 (DE) ..... 10 2015 112 214

(51) Int. Cl.
*E04F 15/10* (2006.01)
*E04F 15/12* (2006.01)
*E04F 15/18* (2006.01)

(52) U.S. Cl.
CPC ..... *E04F 15/12* (2013.01); *E04F 15/186* (2013.01); *E04F 2290/00* (2013.01)

(58) Field of Classification Search
CPC ..... E04F 15/12; E04F 15/186; E04F 2290/00; G08G 1/0116
See application file for complete search history.

(56) References Cited

U.S. PATENT DOCUMENTS 6,114,046 A * 9/2000 Hanoka ..... B32B 17/10018 136/251
6,478,229 B1 11/2002 Epstein

FOREIGN PATENT DOCUMENTS

| | | |
|---|---|---|
| DE | 10307505 | 9/2004 |
| DE | 102006027213 | 12/2007 |
| DE | 102007001225 | 7/2008 |
| DE | 102007030829 | 1/2009 |

(Continued)

*Primary Examiner* — Patrick J Maestri
(74) *Attorney, Agent, or Firm* — Hoffmann & Baron, LLP

(57) ABSTRACT

A floor covering as a covering for a subfloor, wherein the floor covering has a layer which is composed of a curable material which is cured in the finished state of the floor covering and into which a reinforcing fabric and at least one electrical component are embedded. The at least one electrical component is connected by way of its bottom side to a subfloor, in particular an unfurnished floor, by adhesive bonding, and the reinforcing fabric covers the at least one electrical component by way of its side which is averted from the subfloor, so that the top side of the at least one electrical component is covered by the reinforcing fabric and the curable material.

23 Claims, 3 Drawing Sheets

(56) References Cited

FOREIGN PATENT DOCUMENTS

| | | |
|---|---|---|
| DE | 102008010530 | 8/2009 |
| DE | 102012107412 | 5/2014 |
| EP | 2374857 | 10/2011 |
| FR | 2956137 | 8/2011 |
| WO | WO2004076731 | 9/2004 |
| WO | WO2007033980 | 3/2007 |

* cited by examiner

FLOOR COVERING COMPRISING AT LEAST ONE ELECTRICAL COMPONENT AND METHOD FOR PRODUCING A FLOOR COVERING

This application claims priority based on an International Application filed under the Patent Cooperation Treaty, PCT/EP2016/067582, filed Jul. 22, 2016, which claims priority to DE102015112214.6, filed Jul. 27, 2015.

BACKGROUND OF THE INVENTION

The invention relates to a floor covering as a covering for a subfloor, wherein the floor covering comprises a layer of a curable material, which is cured in the finished state of the floor covering and into which a reinforcing fabric and at least one electrical component are embedded.

Such a floor covering is explained, for example, in DE 10 2008 010 530 A1. The electrical component part in this floor covering is, for example, an electronic component, in particular an RFID chip. It is proposed that the electronic component be applied onto the reinforcing fabric or introduced into the reinforcing fabric, and that this reinforcing fabric then be laid on the base before the curable material is incorporated into the reinforcing fabric. The electronic component is, for example, laid or arranged in windows of the reinforcing fabric, so that it is covered on the upper side by the curable material.

A disadvantage with this design is that damage to the electronic components may occur, for example when the curable material in the still soft state is spread between the electronic components with a spatula or another such processing tool. Furthermore, the holding of the electronic components on or in the floor covering is to be improved.

SUMMARY OF THE INVENTION

On the basis thereof, the object of the invention is to provide an improved floor covering.

In order to achieve the object, in a floor covering of the type mentioned in the introduction, it is proposed that the at least one electrical component is connected with its lower side to a subfloor, in particular to an unfinished floor, with the aid of adhesive bonding, and the reinforcing fabric covers the at least one electrical component with its side that faces away from the subfloor, so that the at least one electrical component is covered on the upper side by the reinforcing fabric and the curable material.

Below the electrical component, there is an adhesive layer. The adhesive layer may be a continuous adhesive layer which extends over the entire subfloor or sizeable surface regions, or an adhesive layer which is only provided respectively immediately below the respective electrical component. It is thus possible for the adhesive layer to cover a larger area than the electrical component or the electrical components.

It is furthermore possible that the adhesive layer only adhesively bonds subregions of the electrical component to the subfloor, for example that one or more adhesive spots are provided. The electrical component thus does not need to be adhesively bonded fully to the subfloor, but may be adhesively bonded to the subfloor only on a subsection or a plurality of subsections of its lower side. For example, it is possible for the electrical component to be adhesively bonded to the subfloor only in an edge region.

It is also possible that the electrical component is adhesively bonded indirectly to the subfloor, namely by its being fastened on a carrier material, for example on a cladding, which itself is in turn adhesively bonded to the subfloor.

It is an advantageous approach that the at least one electrical component, for example an electronic component and/or an electrical sensor conductor, is connected to the subfloor by adhesive bonding, so that the respective electrical components cannot be lifted from the subfloor or float when the curable material is applied. A bonding course is present between the at least one electrical component, for example an electronic component and/or an electrical sensor conductor, and the subfloor.

The respective electrical component is thus fastened reliable at a predetermined position, so that it can optimally provide its electrical function. Specifically, for example by array spacings between the electrical components being complied with reliably, locating functions, sensing functions or the like can be carried out optimally.

The at least one electrical or electronic component or the sensor conductor thus remains in position when the curable material is applied, the latter then additionally ensuring firm holding of the at least one electrical component or the sensor conductor in relation to the base. In a further processing step, the curable material and the reinforcing fabric are arranged above the at least one electronic component or the at least one sensor conductor, so that the reinforcing fabric protects these component parts against mechanical influences, particularly during processing of the curable material and/or during use of the floor covering.

With the aid of the curable material, which for example comprises a synthetic resin, for example epoxy resin, polyurethane resin or the like, the reinforcing fabric forms an integrated upper composite seal of the floor covering, which offers some advantages. For example, regions of a building exposed to moisture, for example kitchens, sanitary installations or the like, may be equipped with the floor covering.

The reinforcing fabric advantageously covers the electrical component on its surface with at least one fibre, preferably a fibre arrangement having a plurality of fibres or fibres woven together.

The floor covering may thus for example provide a top seal, and in particular a seal against moisture, of the subfloor as well as of the electrical components, for example RFID tags, arranged in a sandwiched fashion between the subfloor and the reinforcing fabric. The floor covering, so to speak functionally enhanced by the electrical components, is therefore suitable, for example, for use in an industrial environment, in commercial kitchens, in the clinical field or the like.

The floor covering may be covered on the upper side, for example, with tiles or in particular continuous seamless coverings, for example likewise made of a synthetic resin material. In this case, not only the upper layer, but also the curable material together with the reinforcing fabric, form a moisture retardant or moisture barrier.

The floor covering also improves the so-called adhesive tensile strength and/or ensures optimal crack bridging. If for example the subfloor, for example the unfinished floor, comprises cracks, joints or the like, the floor covering according to the invention forms a stable bridge over these.

The reinforcing fabric above the at least one electrical component ensures optimal protection. A compressive stress from above therefore does not act on the electrical component, or acts on it at most to a small extent, so that the component is not affected, or is affected only little.

The floor covering forms a stable base for further coverings or covering layers, for example carpet, tiles, parquet, or a resilient covering or the like.

The floor covering is quasi-monolithic, i.e. coverings with low resilience, for example synthetic resin coverings, tiles or the like, may also be arranged above the floor covering.

The floor covering according to the invention is expediently seamless and/or continuous, i.e. without interruption, between bounding walls or side walls of the building.

Upper coverings which are likewise seamless or continuous between side walls or bounding walls of a building, for example PVC, linoleum, synthetic resin coverings or the like, may expediently be arranged on the floor covering according to the invention. The floor covering is a stable carrier for these.

The at least one electrical component may for example be at least one electronic component, in particular a semiconductor element, a sensor, a locating element or the like, and/or at least one electrical sensor conductor of a sensor arrangement.

The sensor conductor is, for example, provided and/or configured for recording by sensing at least one physical quantity, in particular a magnetic field and/or an electric field or a pressure. In particular, the sensor conductor is preferably provided and/or configured for physically recording a person or an object situated on the floor covering.

The electronic components are or comprise, for example, so-called locating elements, in particular radio tags or RFID tags. Furthermore, the electronic components may also comprise sensor elements, i.e. for example load sensors, capacitive sensors, inductive sensors, acceleration sensors or the like.

The floor covering may of course comprise only electronic components or only sensor conductors. The combination is, however, more particularly advantageous. With the aid of the sensor conductor or the sensor conductors, for example, locating of an object or a person on the floor covering is possible.

With the aid of the electronic component or the electronic components, for example, a vehicle, in particular a self-driving vehicle, or a robot may determine its position. The vehicle is for example a cleaning robot, a warehouse vehicle, a transport robot or the like. For example, the electronic components forward location information to the vehicle, so that the latter can navigate on the floor covering. With the aid of the electronic components, for example, vehicles may be autonomously mobile on the floor covering or navigate independently. With the aid of the sensor conductors, the position of the respective vehicle is recorded actively, that is to say the sensor arrangement, arranged for example at the edge of the floor covering, may determine the position of the vehicle independently of the functionality of the vehicle.

The functions of the sensors expediently also comprise safety functions. For example, a person who is for example moving independently of the vehicle or the vehicles on the floor covering may be located. The sensor arrangement may for example record whether a person is standing, i.e. moving uninjured, or lying on the floor. A high level of safety may therefore be achieved, for example by the respective vehicle or the vehicles, or other automation systems and devices, in the region of the floor covering according to the invention being stopped automatically when a person is lying on the floor or there is a threat of a collision with the vehicle.

The electronic component is or comprises, for example, a semiconductor chip, in particular an RFID chip. The electronic component may also be a sensor, in particular a load sensor, force sensor or the like. It is for example possible for a plurality of different electronic components, for example sensor elements and RFID chips, to be provided.

For the adhesive bonding, a so-called synthetic resin undercoat may for example be used, for example epoxy resin undercoat, polyurethane resin undercoat, acrylic resin undercoat or the like.

The at least one sensor conductor comprises, for example, an electrical conductor track, which is fixed on the base with the aid of the adhesive bonding.

For example, electrically conductive metal strips, in particular aluminium strips and/or copper strips, are suitable as sensor conductors. Metal strips have a flat configuration and are strip-like. Electrical cables, i.e. electrical conductors which do not have a flat configuration, may, however, also be used successfully in practice.

The at least one sensor conductor may, for example, be a constituent part of a grid, i.e. a conductor grid is provided. Zones, which may be recorded by sensing with the aid of the sensor conductors respectively bounding them, are then formed between the respective sensor conductors.

The at least one electrical component expediently comprises a plurality of sensor conductors arranged in an array parallel in a transverse direction or parallel in a longitudinal direction, or a plurality arranged longitudinally parallel and a plurality arranged transversely parallel to one another. For example, the sensor conductors are arranged at a right angle to one another so that rectangular zones are provided between the conductor tracks or sensor conductors. It is, however, also possible for the sensor conductors not to be arranged at a right angle to one another, so that for example diamond-shaped zones are formed between the sensor conductors.

The sensor conductors are for example connected to a sensor, for example a capacitive or inductive sensor. In this way, it is possible for example or a person who is situated in a respective array grid to be recordable with the aid of the sensor by the electric and/or magnetic field conditions modified by the person in this array zone.

According to one advantageous method of fastening the at least one electrical component on the subfloor, for example, this component is arranged on a cladding material, the cladding material with the electrical component arranged thereon being adhesively bonded to the subfloor or unfinished floor. The cladding material is, so to speak, the carrier for the at least one electrical component, in order to fit it advantageously on the subfloor or unfinished floor.

It is possible that a surface extent, for example width, of the cladding material to be greater than a surface extent or width of the at least one electrical component, so that the cladding material extends beyond the electrical component on at least one side, which facilitates fitting on the subfloor.

It is readily possible for a plurality of electrical components to be arranged on the cladding material, for example at equal distances from one another in the longitudinal direction or transverse direction, or both. For example, the cladding material may be configured in the manner of a strip, and may for example form a strip, and the electrical components may be arranged behind one another on the cladding material in a row direction. It is, however, also possible for the electrical components to be arranged in the form of a matrix or in a grid array next to one another on the cladding material.

Expediently, the strip material or cladding material is relatively narrow, so that it is easy to handle. A width of the strip material or cladding material of about 5-15 cm, expediently about 8-12 cm, is preferred. In practice, the laying of such a cladding material on the subfloor has been found to be particularly favourable.

With the aid of the cladding material, the equidistant arrangement of electrical components, or at least the arrangement of components at predefined but different distances, on the subfloor is facilitated significantly. The components are arranged at the desired distances on the cladding material, which is then merely laid out on the subfloor and bonded thereto. The cladding material may, for example, be rolled up and already contain the electrical components. The cladding material is then, for example, unrolled on the subfloor while preferably being adhesively bonded at the same time.

According to one expedient configuration of the invention, the cladding material comprises a fabric or is formed by a fabric. It is possible for the cladding material to consist of the same material as the reinforcing fabric.

Preferably, a mechanical load-bearing capacity of the cladding material is significantly less than that of the reinforcing fabric. This is because the reinforcing fabric has a protective function for the at least one electrical component, while the cladding material so to speak constitutes an aid for fitting on the subfloor.

The cladding material is preferably a material which is permeable for the adhesive layer. For example, a fabric, nonwoven or the like may advantageously be used.

Expediently, the cladding material is chemically stable in relation to the adhesive material between it and the subfloor, i.e. it is not dissolved or is dissolved only insubstantially by the adhesive material.

It is furthermore advantageous for the cladding material not to be lengthened and/or dissolved by the adhesive material. For example, a paper nonwoven may be dissolved or lengthened by the adhesive material. It is therefore advantageous for the cladding material to consist of or at least comprise a plastic material and/or textile material and/or glass fibres.

Expediently, the cladding material is very thin, so that it has no effects, or only insubstantial effects, in terms of the height of the subfloor. For example, a height of the cladding material of between 0.5 and 2 mm, particularly preferably about 1 mm, is expedient.

The cladding material is expediently flexible or pliable, so that it can be rolled together with the electrical components arranged thereon. For example, it may therefore be rolled up into a roll, which can be unrolled easily on the subfloor.

The at least one electrical component expediently comprises an adhesive layer for application on the reinforcing fabric or the subfloor. For example, adhesive layers may be provided on a lower side and an upper side of the electrical component, so that it can be adhesively bonded on the one hand to the subfloor and on the other hand to the reinforcing fabric. The adhesive layers may be covered by a protective film or protective layer, which is removed before application on the subfloor and respectively before application of the reinforcing fabric. It is, however, also readily possible for the component to comprise only one adhesive layer, for example on its upper side for the reinforcing fabric or on its lower side for the subfloor.

For the electrical component, in particular the electronic component, it is advantageous for it to be arranged in a protective encapsulation. For example, a protective housing for an electronic semiconductor component, a chip or the like is advantageous.

The unfinished floor or subfloor is generally sharp-edged or uneven. This may lead to damage of electrical components, for example chips or other semiconductors. Electrical conductors or conductor tracks, i.e. the sensor conductors, may also be damaged by their being applied directly on the unfinished floor.

Expediently, therefore, the at least one electrical component is provided with a protective layer or a protective encapsulation.

It is expedient for the at least one electrical component to be covered with a foam material, in particular a layer of foam material, on at least one side, preferably on several or all sides. The foam material may, for example, be a mineral foam. A plastic foam is particularly preferred. In practice, polyurethane has proven suitable as a foam material. As an alternative to the foam material, or as a supplement thereto, a shell material made of a resilient substance, for example a resilient plastic, rubber or the like, is also possible.

The sensor conductor may also have a protective layer, for example a foam layer or another resilient layer, on its upper side or its lower side, or both. Expediently, a resilient or soft protective layer is provided, which so to speak compensates for possible irregularities, in particular sharp-edged projections of the subfloor.

The foam material has the advantage that it enters into a bond with the curable material, or the curable material can penetrate into the foam material, which constitutes particularly firm holding of the at least one electrical component in the curable material when the latter is cured. A kind of protective encapsulation, which consists of foam material, is particularly preferred.

Furthermore, the foam material, or also the resilient material, has the advantage that it has a certain flexibility, i.e. a load which occurs in the direction of the resilient component can be flexibly absorbed by the foam material.

It is furthermore conceivable for a locating element, sensor element or another electronic component in the floor covering according to the invention to be arranged in a hard encapsulation. A combination of hard encapsulation and soft encapsulation, i.e. for example a hard plastic and a foam material, is also readily possible.

Preferably, the at least one electrical component is provided with electrical screening on its lower side that faces towards the subfloor. This measure serves, for example, to avoid or reduce perturbing influences, which may for example be caused by metal reinforcement of the subfloor (steel-reinforced concrete, etc.). The electrical screening comprises, for example, an electrically conductive layer or an electrically conductive plate. The screening may also be or comprise a screening fabric. The electrical screening may be connected to earth or ground. It is also possible for the screening to be adhesively bonded to the subfloor. It is furthermore possible for the screening to form a constituent part of the electrical component.

The at least one curable material, and/or the adhesive provided for adhesive bonding of the at least one electrical component, may for example comprise a synthetic resin material, in particular synthetic resin, for example epoxy resin, polyurethane resin, acrylic resin or the like, and/or a mixture of at least two synthetic resins, for example epoxy resin, polyurethane resin, acrylic resin or the like.

The synthetic resin, for example epoxy resin, polyurethane resin, acrylic resin or the like, is for example a synthetic resin consisting of polymers, to which a curing agent is added so that it cures to form a thermoset plastic with high strength and chemical stability. The originally liquid or paste-like mixture cures as a function of the composition and temperature, for example within a few minutes to a few hours or days.

The curable material may, however, also comprise a dispersion adhesive material.

It is possible that the at least one curable material comprises a mineral material, and for example contains cement, or comprises concrete or a plastic-modified filler compound. The material of the adhesive for the at least one electrical component, for adhesive bonding to the subfloor, may also consist of or comprise such a material.

The curable material, for example a synthetic resin material, for example epoxy resin, polyurethane resin, acrylic resin or the like, or a mixture of a plurality of synthetic resins, constitutes a bond with the subfloor, for example a screed or concrete or cavity floor system or a double floor system. In any event, the floor system may comprise subelements, the transition regions of which are covered by the floor covering according to the invention. For example, a so-called cavity floor system or double floor system consists of floor elements which lie next to one another on carriers or another similar base.

At this point, it should be mentioned that although the curable material is preferably homogeneous, i.e. only a single curable material is used, a layer structure is nevertheless also possible, i.e. for example a mineral layer of the curable material directly with the subfloor.

The reinforcing fabric is, for example, a fabric comprising fibres of polyethylene or polypropylene or polyester. Carbon fibres or glass fibres or natural fibres are also readily possible. The reinforcing fabric expediently comprises an electrically nonconductive fabric, so that it has no effect on the electrical function of the electrical component part or of the electrical component, for example the sensor conductor or the chip.

The reinforcing fabric is expediently a roll material, which can be processed or unrolled easily. In practice, a width of the reinforcing fabric of about 80-120 cm has been found to be advantageous and easily processable. With this width, the reinforcing fabric on the one hand can still be unrolled favourably, and on the other hand it is wide enough to provide tensile strength, and therefore mechanical load-bearing capacity, over relatively large surface regions.

An expedient layer thickness of the curable material is, for example, about 1 to 10 mm, in particular 5 to 8 mm. A layer thickness of, for example, from 1 mm to 2 mm or from 2 mm to 3 mm is also readily advantageous.

A layer thickness or material thickness of the curable material is advantageously selected in such a way that the at least one electrical component, or all electrical components, are covered by the curable material. Expediently, a layer of the curable material above the at least one electrical component is about 2-3 mm, in particular 4-5 mm.

The reinforcing fabric expediently lies flat on the at least one electrical component or the electrical components. It is of course possible for there to be slight elevations in the region of the electrical components. Elevations occur, for example, when a protective encapsulation or protective housing, in which the chip is arranged, is additionally provided.

According to one expedient embodiment of the invention, the floor covering comprises a resilient layer or a resilient covering above the curable material. The resilient layer is expediently applied onto the curable material after curing of the latter.

The resilient covering may, for example, form damping for impact noise. The resilient covering is also advantageous in terms of ergonomic aspects, for example to relieve the stress on the muscles and/or joints of the users of the floor covering. Room acoustics may also be improved by the floor covering of the resilient layer.

The floor covering is thus on the one hand equipped functionally by virtue of the electrical component or the electrical components, for example for navigation purposes or sensing purposes, and on the other hand ergonomically, specifically by the resilient layer or the resilient covering flexibly damping footsteps, for example. The resilient covering of the resilient layer also has, however, advantages to the extent that possible compressive stresses are not transmitted directly onto the electrical component or components, but are absorbed.

At this point, it should be noted that the entire functionality, i.e. navigation, sensing and ergonomics, may have course be combined, that is to say for example locating elements, sensing elements, for example the sensor conductors, and also the ergonomically favourable resilient covering may be provided. It is however possible that, for example, only locating elements or only sensor elements or sensor conductors are provided, above which the resilient covering is arranged.

A hard layer or a top floor may be provided on the resilient covering and/or the curable material. The hard layer so to speak floats on the resilient covering. The hard layer is harder than the resilient covering. For example, the hard layer consists of a synthetic resin material, in particular of a synthetic resin, for example epoxy resin, polyurethane resin, acrylic resin or the like. It is in any event possible for a seamless layer or a seamless covering to be arranged above the resilient covering.

For example, a hard covering, for example made of polyurethane resin, the modulus of elasticity of which is equal to or approximately equal to that of the resilient covering, is provided above the resilient covering.

The hard covering may, however, also have a modulus of elasticity which is greater than that of the resilient covering.

For example, a rubber granulate is suitable as the resilient layer or resilient covering. The granulate may so to speak be scattered and subsequently bound with a binder, or merely covered by a further covering arranged above the resilient layer. A mat material is however preferred, for example a rubber granulate in mat form or as roll material.

A particularly preferred layer thickness of the resilient layer is, for example, about 2-5 mm. It may however be somewhat higher or thicker, for example 6-8 mm.

According to one expedient embodiment of the invention, the subfloor or unfinished floor is pretreated, for example by grinding and/or grit blasting, so that it is optimally prepared for the adhesive bonding of the at least one electrical component. It is preferred for the subfloor or unfinished floor to be uniformly planar. According to one advantageous measure, the subfloor or unfinished floor is evened or pretreated in such a way that it is planar before the application of the floor covering according to the invention.

Expediently, the subfloor or unfinished floor is porous, either naturally or because of the aforementioned processing, so that it allows connection to the adhesive layer and therefore the electrical components and/or connection to the curable material.

Advantageously, the subfloor or unfinished floor is cleaned, for example suctioned or washed, after the abrasive pretreatment. The purpose of this is to provide a maximally dust-free surface for the application of the at least one electrical component and subsequently the curable material.

The electronic components or electrical components are expediently adhesively bonded to the subfloor or unfinished floor with a curable adhesive or adhesive material. The adhesive or adhesive material is expediently the same material as that in which the electrical component or the electrical components are subsequently embedded. The adhesive thickness of this adhesive layer is less than the installation height of the electrical component or of the electrical components. The electrical component or components therefore protrude upwards from the adhesive layer. Subsequently, reinforcing fabric is applied above the electrical component or the electrical components, and finally the curable material is introduced. It is also possible to apply the curable material onto the components to be bonded to the subfloor or unfinished floor, and then to apply the reinforcing fabric.

The electrical components or the electrical component are thus, for example, adhesively bonded onto the subfloor with a synthetic resin bonding course or a polyurethane adhesive, before the reinforcing fabric and subsequently the curable material, or first the curable material and subsequently the reinforcing fabric, are applied.

These working steps are expediently carried out very rapidly and quickly, in such a way that the adhesive is not yet fully bonded when the curable material is applied, and in particular a skin has not yet formed on its upper side, or only a skin which can be dissolved again by the curable material, which is for example applied before the reinforcing fabric or introduced through the reinforcing fabric.

Expediently, so to speak wet-in-wet processing is carried out, that is to say the adhesive material is still unbonded and bondable when the curable material is applied or introduced, i.e. the second bonding course is applied. The second bonding course bonds to the first bonding course of the adhesive layer, with which the at least one electrical component is adhesively bonded on the subfloor or base.

It is, for example, possible that the curable material is first applied onto the at least one electrical component, and the reinforcing fabric is subsequently pressed into the still bondable or soft curable material. It is, conversely, also conceivable that the reinforcing fabric is laid first, i.e. reliably covers the at least one electrical component or the arrangement of a plurality of electrical components, before the curable material is applied.

According to one preferred method, the reinforcing fabric is pressed into the curable material by spreading, i.e. with the aid of a spatula tool. It is also possible that the reinforcing fabric already lying on the at least one electrical component is provided from above with the curable material, i.e. that the curable material is introduced through the reinforcing fabric with a spatula or another processing tool into the intermediate spaces of the reinforcing fabric and the intermediate spaces between the electrical components.

It is preferred for the adhesive for adhesively bonding the at least one electrical component to the subfloor, and/or for the curable material, to have a predetermined resilience even after curing, so that for example cracks of the subfloor can be bridged. Advantageously, the curable material and/or the adhesive has a modulus of elasticity or E modulus of from 100 to 3000 N/mm$^2$, in particular from 100 to 300 N/mm$^2$ or from 50 to 500 N/mm$^2$. The curable material and/or the adhesive may also have a modulus of elasticity of for example from 2000 to 5000 N/mm$^2$, in particular from 3000 to 4500 N/mm$^2$. Advantageously, the curable material and/or the adhesive has a modulus of elasticity or E modulus of from 1500 to 2500 N/mm$^2$.

A tensile strength of the curable material and/or of the adhesive is preferably from 80 to 120 N/mm$^2$.

It is preferred for the resilience of the adhesive and/or of the curable material to be sufficient at least to bridge a crack width of 0.5-1.5 mm, in particular more than 1 mm.

Flexibilised and/or crystallisation-inhibited construction chemicals, in particular epoxy resins, are expedient as the adhesive and/or the curable material.

It is particularly preferred for the at least one electrical component to be embedded so to speak resiliently or flexibly floating in the adhesive and the curable material. The embedding of the electrical component in the layer of the curable material and/or the adhesive is preferably flexible in such a way that, for example, although forces acting because of cracking of the subfloor possibly lead to local displacement of the component, they do not lead to its destruction. For example, screeds are often applied onto shrinking or floating layers, for example of impact noise damping, which leads to cracking of the screed and therefore of the subfloor. Here, the correspondingly flexible and resilient material of the adhesive and/or of the curable material provides assistance by its bridging such cracks and at the same time avoiding, or at least considerably reducing, a tensile stress or other mechanical loading of the electrical component.

It is expedient for the resilience of the adhesive and/or of the curable material to be greater than the resilience of the hard layer arranged directly above the curable material or above the intermediate layer of the resilient material.

A hard layer or top layer of the floor covering arranged above the curable material (particularly in the cured state) preferably has a compressive strength of at least 35 N/mm$^2$, preferably at least 40 N/mm$^2$, particularly preferably at least 45 N/mm$^2$.

BRIEF DESCRIPTION OF THE DRAWINGS

Exemplary embodiments of the invention will be explained below with the aid of the drawing, in which.

DETAILED DESCRIPTION OF THE PREFERRED EMBODIMENTS

Figure 1:
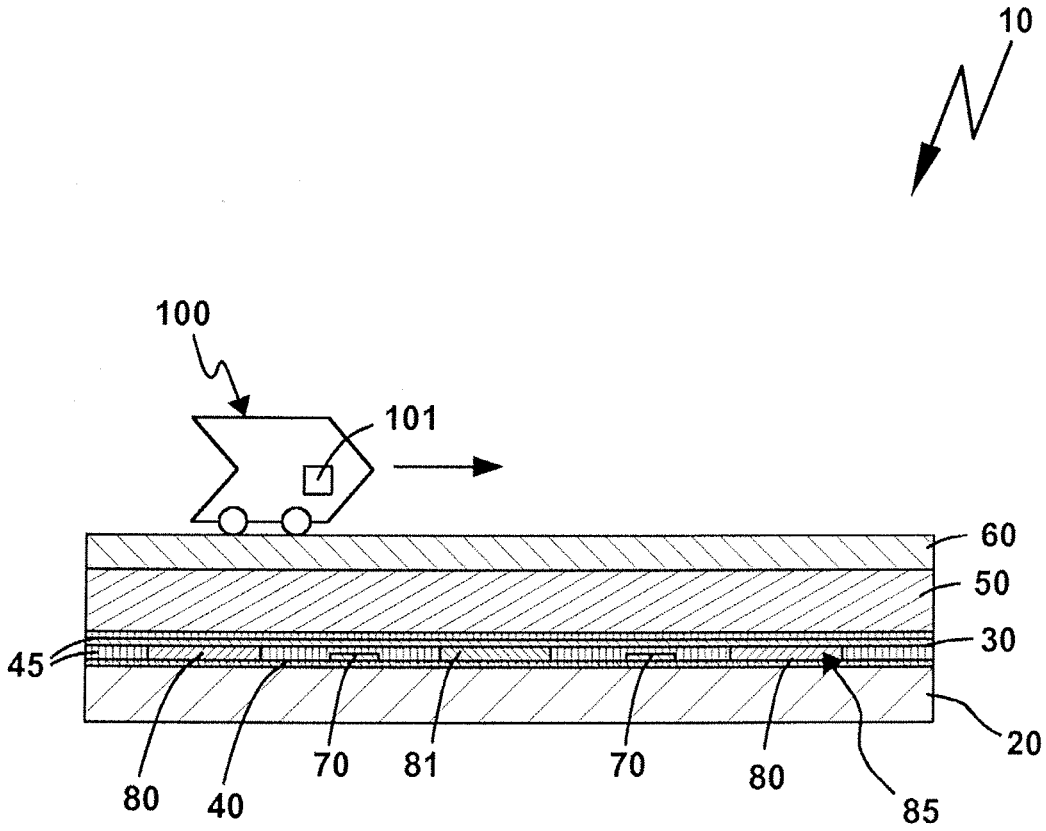
FIG. 1 shows a schematic cross-sectional view of a floor covering.

A floor covering 10 according to the drawing has a layer structure, which is constructed on a subfloor 20, for example an unfinished floor. The unfinished floor may for example be a screed or a concrete floor or a cavity floor system, but in any event a structure capable of carrying the floor covering 10. The subfloor 20 may, for example, be a double floor system. The precise configuration of the unfinished floor or subfloor is not necessarily important, although the aforementioned variants or at least a stable base are preferred.

Electrical components 85 are adhesively bonded onto the subfloor 20 with the aid of an adhesive layer 40. Various types of electrical components are provided in the floor covering 10, which need not necessarily be the case but represents an advantageous option. For example, sensor conductors 71 that are arranged in a grid array are provided as electrical components 85. The sensor conductors 70, 71 are connected to evaluation elements 72, 73 of a sensor arrangement 74, which are for example arranged at the edge of the floor covering 10. The evaluation elements may also be arranged on the upper side of the floor covering 10. The evaluation elements 72, 73 record objects and/or persons situated on the floor covering 10, for example a vehicle 100 or a person 140.

It can be seen that a zone array is spanned between the evaluation elements 72, 73, i.e. for example array regions 75 are provided, of which the array regions 75*a*, 75*b* and 75*c* are denoted individually. Further array regions or array zones are not denoted for reasons of simplicity, although they are also visibly present. Objects or persons situated in the array regions 75, for example 75*a*, 75*b* and 75*c*, change, for example, the capacitive and/or inductive conditions between the sensor conductors 71, 72, and this can be recorded by the evaluation elements 72, 73. For example, it may be recorded by the sensor arrangement 74 that the person 140, because he is not only in one or two of the array regions 75, but influences in total three array regions, namely the array regions 75*a*, 75*b* and 75*c*, as well as other array regions (not denoted in detail). The aforementioned array regions 75*a*, 75*b* and 75*c* are, however, almost fully covered by the person 140. The sensor arrangement 74 can therefore determine that the person 140 is lying on the floor covering 10 and no longer standing. This is because if the person 140 were standing, he would only influence one or two array regions 75.

Furthermore, with the aid of the adhesive layer 40, locating elements 80 as well as sensor elements 81 are adhesively bonded on the subfloor 20. The locating elements 80 and sensor elements 81 may be electrical components 85.

The locating elements 80 are for example arranged on cladding strips 41, and the locating elements 81 on cladding strips 42. The cladding strips 41, 42 are adhesively bonded in a grid array on the subfloor 20. Equal distances are respectively provided between the locating elements 80 on the cladding strips 41 and the sensor elements 81 on the cladding strips 42. The cladding strips 41 are respectively arranged parallel next to one another, and likewise the cladding strips 42 parallel next to one another, on the subfloor 20. For example, the cladding strips 41, 42 extend at a right angle to one another, although other angular arrangements are also possible.

Furthermore, it is only one advantageous option that, as in the exemplary embodiment of the drawing, for example the sensor conductors, locating elements and sensor elements in a floor covering according to the invention are arranged in an array on the subfloor. A chaotic arrangement of the electrical components on the subfloor, which is for example analysed by a subsequent measurement, would also be readily possible.

The sensor elements 81 and the locating elements 80 are thus adhesively bonded in a grid array on the subfloor per se. The cladding strips 41, 42, i.e. a cladding material 43, make it easier to apply them on the subfloor 20 in the aforementioned array spacing.

The locating elements 80 are or comprise, for example, RFID tags 82 which can be read out by a corresponding reader device 101 of a vehicle 100. With the aid of the locating elements 80, the vehicle 100 can navigate on the floor covering 10. For example, the locating elements 80 respectively comprise a chip 87 and an antenna 86, which form constituent parts of the RFID tag. The structure of such components is known. In any event, these components do not require an energy source, but are supplied with corresponding energy by the reader device 101, specifically by the antenna 86, during readout.

The sensor elements 81 are for example pressure sensors, load sensors or the like, which can record loading of the floor covering 10 and therefore presence of, for example, the vehicle 100 or the person 114. Of course, other sensing functions, for example electric field, inductive influences or the like, may be recorded by sensing by sensor elements in the manner of the sensor elements 81. The sensor elements 81 represent an advantageous option.

Figure 2:
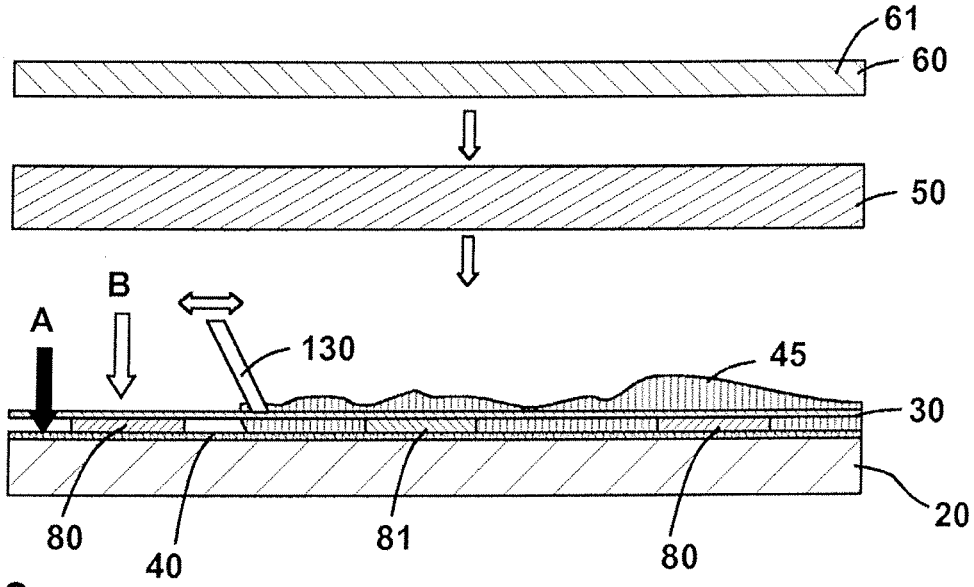
FIG. 2 shows a view of the floor covering according to FIG. 1 during production.
Figure 3:
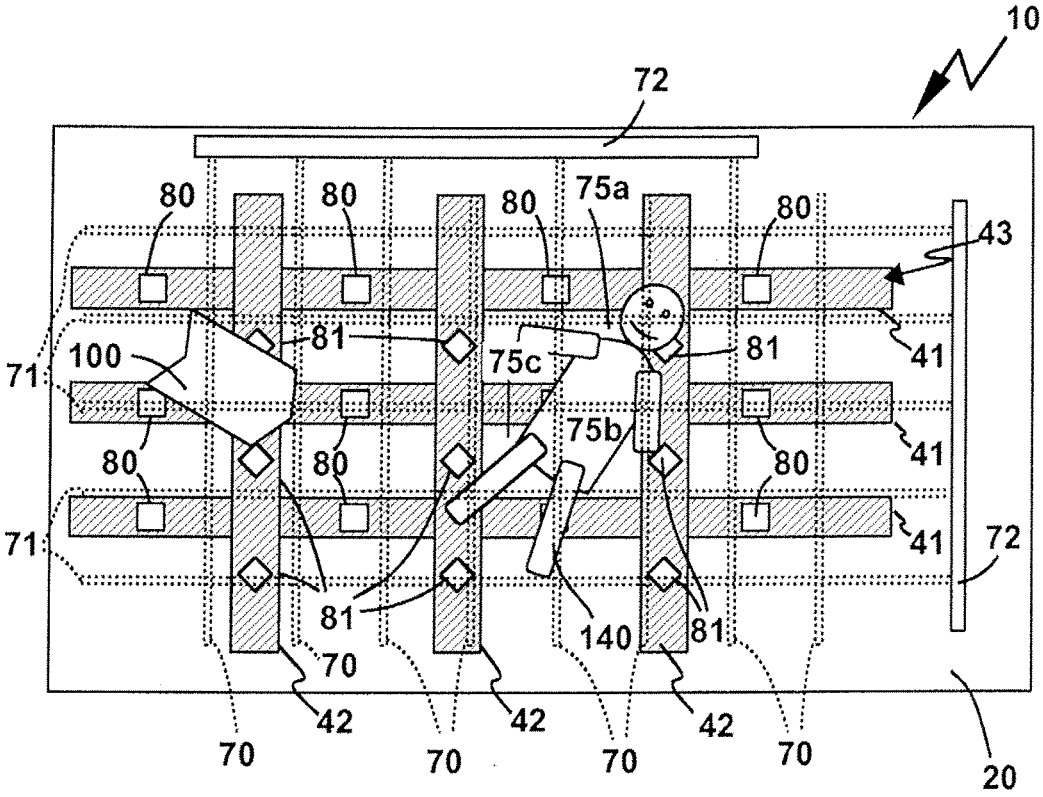
FIG. 3 shows a plan view of the floor covering according to FIG. 2, approximately corresponding to the arrow A.
Figure 4:
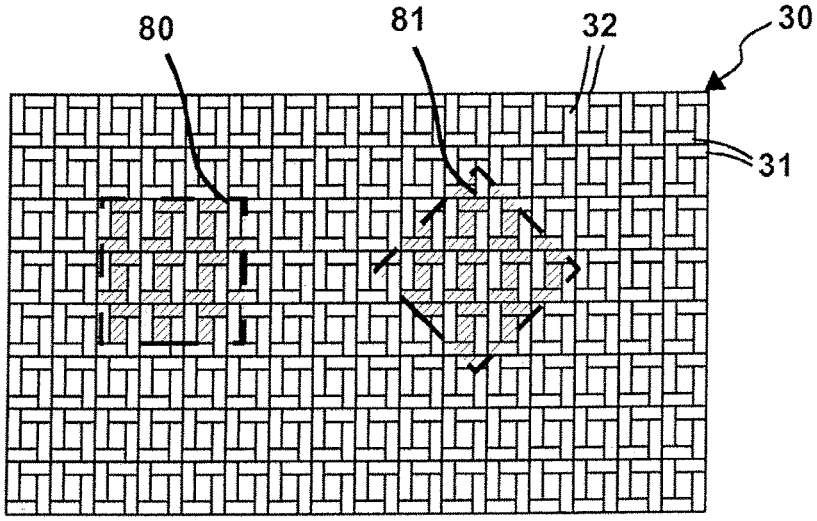
FIG. 4 shows a plan view of the floor covering according to FIG. 2, approximately corresponding to the arrow D.

Initially, the sensor elements 81, the locating elements 80 and the sensor conductors 70, 71 are thus unprotected on the upper side when they are adhesively bonded on the subfloor 20. This corresponds in principle to the representation according to FIG. 2, in the left-hand region, the reinforcing fabric 30 explained below not yet being present.

In fact, a reinforcing fabric 30, which protects the sensitive electrical components 85 on their upper side that faces away from the subfloor 20, is arranged above the electrical components 85.

In this case, various procedures are advantageous, namely:

First, the reinforcing fabric 30 is arranged above the electrical components 85, before a curable material 45 is introduced between the electrical components 85 and above the components 85. For example, the mass of the curable material 45, so long as it is still liquid or paste-like, is spread with a spatula tool 130.

It is furthermore possible that at least a part of the curable material 45, or the entire curable material 45, is initially cast onto the adhesive layer and the components 85, before the reinforcing fabric 30 is spread or pressed into the still soft mass of the material 45 with the aid of the spatula tool 130 or another processing tool.

In both cases mentioned above, the components 85 are protected on the upper side by the reinforcing fabric 30 when the spatula tool 130 or another processing tool is employed. The processing tool thus cannot damage the components 85.

During the aforementioned processing of the curable material 45, wet-in-wet processing is preferably carried out, that is to say the adhesive layer 40 should not yet be cured before the curable material 45 is introduced. Thus, on the one hand, the adhesive layer 40 forms a bonding course with the subfloor 20, and on the other hand the curable material 45 forms a bonding course with the adhesive layer 40 and the components 85. A homogeneous mass is obtained.

At this point, it should be mentioned that the material of the adhesive layer 40 is expediently the same as that of the curable material 45, for example a synthetic resin material, for example epoxy resin material, polyurethane resin material, acrylic resin material or the like.

When the curable material 45 is cured, it reliably encloses the components 85, so that mechanical loads on the components 85 are at least substantially avoided.

Advantageously, when it is cured, the curable material 45 forms a homogeneous and continuous layer, which does not have any seams, above the components 85.

It is furthermore expedient for the curable material 45 to constitute a moisture barrier or moisture retardant, so that for example no moisture can reach the components 85 from above. They are thus so to speak hermetically covered from above and protected.

Further component parts, for example a resilient layer 50, may be arranged above the floor covering 10 which is to this extent finished, or for example only partially finished. The resilient layer 50 comprises for example a rubber granulate, for example in mat form. The resilient layer 50 acts as a damping layer or flexible layer, even if a top floor 60, for example in the form of a hard layer 61, a hard floor, linoleum, carpet or the like, is also arranged above the resilient layer 50. Impacts possibly acting on the floor covering 10 from above are therefore absorbed. Furthermore, use of the floor covering 10 is extremely ergonomic because it yields resiliently. The floor covering 10 may therefore, for example, provide sound damping, impact noise damping or the like.

At this point, it should be mentioned that the resilient covering 50 represents one option which is advantageous. It is, for example, possible for the hard layer 61 to be arranged in particular directly, above the curable material 45, without the resilient covering 50 lying in between.

The hard layer 61 may likewise comprise or be formed by synthetic resin, for example epoxy resin, polyurethane resin, acrylic resin or the like. Expediently, the modulus of elasticity of the hard layer 61 is equal to that of the resilient layer 50.

The hard layer 61 has on its upper side a compressive strength of at least 35 $N/mm^2$, preferably at least 40 $N/mm^2$, particularly preferably at least 45 $N/mm^2$. The hard layer 61 can therefore readily carry the weight of the vehicle 100.

The reinforcing fabric 30 has, for example, longitudinal windows 31 and transverse windows 32. Expediently, the reinforcing fabric 30 is made of a glass fibre material. Preferably, the reinforcing fabric 30 is electrically nonconductive, so that the functions of the sensor conductors 70, 71 and of the locating element 80 and of the sensor elements 81 are not influenced by the reinforcing fabric 30.

Figure 5:
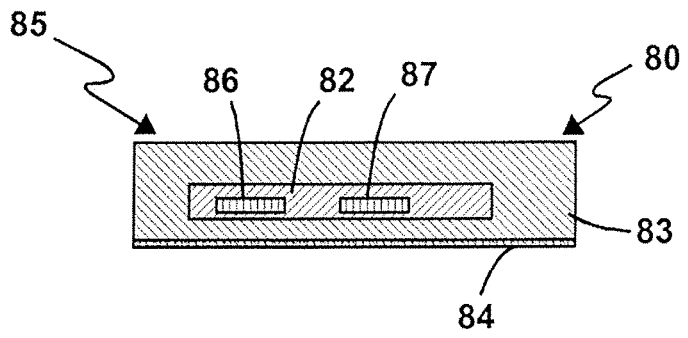
FIG. 5 shows a schematic cross-sectional view through an electrical component, for example a locating element, of the floor covering according to the preceding figures.
Figure 6:
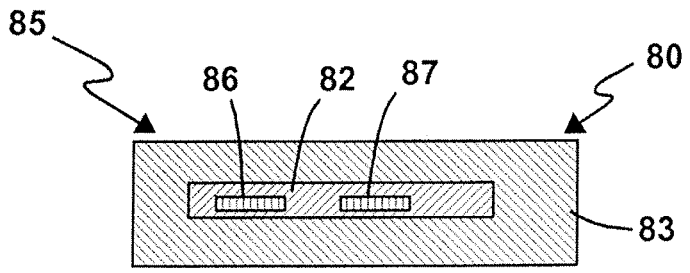
FIG. 6 shows a schematic plan view of the electrical component or locating element according to FIG. 5.

FIG. 5 represents the locating element 80 in detail. The locating element 80 comprises the RFID tag, which is arranged in a protective encapsulation 83. The protective encapsulation 83 has, for example, an adhesive layer 84 which is suitable for fastening on the reinforcing fabric 30 and/or the subfloor 20 or the cladding material 43. A further adhesive layer may readily be provided, for example on the upper side, opposite the adhesive layer 85, of the protective encapsulation 83 on the.

The protective encapsulation 83 expediently consists of a foam material 88, in particular polyurethane. The protective encapsulation 83 is therefore to a certain extent flexible, so that it can absorb and receive impacts or force actions, for example due to the spatula tool 130. The sensitive RFID tag is therefore not damaged.

Expediently, the locating element 80 is enclosed on all sides with the foam material 88. It would, however, also be conceivable for the locating element 80, or another electronic or electrical component, in a floor covering according to the invention to be protected or enclosed only on the upper side, i.e. facing away from the subfloor, only on the lower side, i.e. facing towards the subfloor, or only laterally with the foam material.

This technology, i.e. a protective encapsulation in the manner of the protective encapsulation 83, may also readily be used for the sensor element 81.

Figure 7:
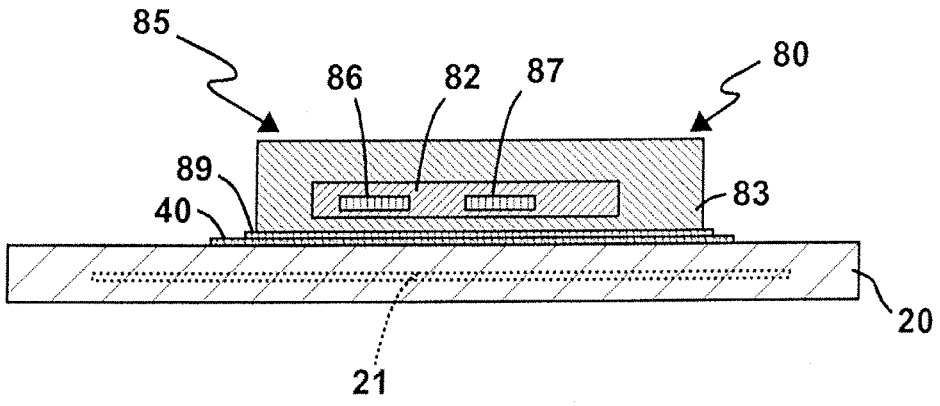
FIG. 7 shows a variant of the arrangement according to FIG. 5, but with screening.

It is furthermore advantageous that, as represented in FIG. 7, electrical screening 89 is provided between the electrical component 85 and the subfloor 20. The screening 89 reduces or avoids, for example, electrical and/or electromagnetic and/or capacitive influences of a steel reinforcement 21, which forms a constituent part of the subfloor 20 or is situated below the subfloor 20. The screening 89 comprises, for example, a screening plate, a screening fabric or the like. The screening 89 may, for example, be adhesively bonded to the subfloor 20 with the aid of the adhesive layer 40. It is possible for the screening 89 to form a constituent part of the electrical component 85, in particular of the locating element 80.

The electrical component 85 is, for example, adhesively bonded to the subfloor 20 with the aid of the adhesive layer 40. The component 85 is preferably connected firmly to the screening 89, for example adhesively bonded or pressed or both. The screening 89 is adhesively bonded to the subfloor 20 with the aid of the adhesive layer 40.

The invention claimed is:

1. A floor covering as a covering for a subfloor, wherein the floor covering comprises a layer of a curable material, which is cured in the finished state of the floor covering and into which a reinforcing fabric and at least one electrical component are embedded, and wherein the reinforcing fabric covers the at least one electrical component by way of its side that faces away from the subfloor, so that the at least one electrical component is covered on the upper side by the reinforcing fabric and the curable material, and wherein the at least one electrical component is arranged on a cladding material, wherein the cladding material with the electrical component arranged thereon is adhesively bonded to the subfloor or unfinished floor, and wherein the cladding material comprises or is formed by a reinforcing fabric.

2. The floor covering according to claim 1, wherein the at least one electrical component comprises at least one electronic component or and/or at least one electrical sensor conductor of a sensor arrangement.

3. The floor covering according to claim 1, further comprising a plurality of sensor conductors arranged in an array.

4. A floor covering as a covering for a subfloor, wherein the floor covering comprises a layer of a curable material, which is cured in the finished state of the floor covering and into which a reinforcing fabric and at least one electrical component are embedded, and wherein the reinforcing fabric covers the at least one electrical component by way of its side that faces away from the subfloor, so that the at least one electrical component is covered on the upper side by the reinforcing fabric and the curable material, and wherein the at least one electrical component is arranged on a cladding material, wherein the cladding material with the electrical component arranged thereon is adhesively bonded to the subfloor or unfinished floor, and wherein the cladding material comprises sheets or strips, or wherein the cladding material comprises or is formed by a fabric.

5. The floor covering according to claim 4, wherein a mechanical load-bearing capacity of the reinforcing fabric is greater than that of the cladding material.

6. The floor covering according to claim 4, wherein a plurality of electrical components are arranged next to one another at equal distances in a longitudinal direction or a transverse direction, or in a matrix or in a grid array on the cladding material.

7. The floor covering according to claim 4, wherein the at least one electrical component comprises an adhesive layer for application on the reinforcing fabric or the subfloor.

8. The floor covering according to claim 4, wherein the at least one electrical component is arranged in a protective encapsulation made of a foam material.

9. The floor covering according to claim 4, wherein the at least one electrical component comprises electrical screening on its lower side that faces towards the subfloor.

10. The floor covering according to claim 4, wherein the at least one electrical component is covered on at least one side with a resilient shell material or a foam material.

11. The floor covering according to claim 4, wherein the curable material comprises or is formed by a mineral material, or a synthetic resin material, or a dispersion adhesive material.

12. The floor covering according to claim 4, wherein the curable material has a layer thickness of about 1-7 mm, or the at least one electrical component is covered fully with a layer thickness of about 2-3 mm or 4-5 mm, with the curable material.

13. The floor covering according to claim 4, wherein the reinforcing fabric comprises fibres of polyethylene or polypropylene or polyester or carbon or glass or natural fibres or electrically nonconductive fabric.

14. The floor covering according to claim 4, wherein the reinforcing fabric covers the surface of a plurality of electrical components arranged next to one another.

15. The floor covering according to claim 4, wherein the reinforcing fabric is laid as sheets over a plurality of electrical components.

16. The floor covering according to claim 4, wherein the at least one electronic component is or comprises a sensor element or a radio identification data medium.

17. A floor covering as a covering for a subfloor, wherein the floor covering comprises a layer of a curable material, which is cured in the finished state of the floor covering and into which a reinforcing fabric and at least one electrical component are embedded, and wherein the reinforcing fabric covers the at least one electrical component by way of its side that faces away from the subfloor, so that the at least one electrical component is covered on the upper side by the reinforcing fabric and the curable material, and wherein a resin layer made of a synthetic resin material is arranged on an upper side of the curable material.

18. A floor covering as a covering for a subfloor, wherein the floor covering comprises a layer of a curable material, which is cured in the finished state of the floor covering and into which a reinforcing fabric and at least one electrical component are embedded, and wherein the reinforcing fabric covers the at least one electrical component by way of its side that faces away from the subfloor, so that the at least one electrical component is covered on the upper side by the reinforcing fabric and the curable material, and wherein a resilient layer is arranged on an upper side of the curable material.

19. The floor covering according to claim 18, wherein a resin layer made of a synthetic resin material is arranged on the resilient layer or the resilient covering.

20. The floor covering according to claim 18, wherein the curable material or an adhesive or an adhesive layer for adhesively bonding the electrical component to the subfloor has a resilience sufficient for crack bridging of a crack width of at least 0.5-1 mm.

21. The floor covering according to claim 18, wherein the curable material or an adhesive or an adhesive layer for adhesively bonding the electrical component to the subfloor has a modulus of elasticity of from 100 to 3000 $N/mm^2$.

22. The floor covering according to claim 18, wherein the curable material or an adhesive or an adhesive layer for adhesively bonding the electrical component to the subfloor is more resilient than a resin layer arranged on an upper side of the curable material.

23. The floor covering according to claim 18, wherein the floor covering has a compressive strength of at least 35 $N/mm^2$ on its upper side.

* * * * *